US011363707B2

(12) United States Patent
Lee et al.

(10) Patent No.: US 11,363,707 B2
(45) Date of Patent: Jun. 14, 2022

(54) POLARIZATION APPARATUS

(71) Applicant: CREATING NANO TECHNOLOGIES, INC., Tainan (TW)

(72) Inventors: Ji-Yung Lee, Tainan (TW); Andrew Ronaldi Tandio, Tainan (TW)

(73) Assignee: CREATING NANO TECHNOLOGIES, INC., Tainan (TW)

( * ) Notice: Subject to any disclaimer, the term of this patent is extended or adjusted under 35 U.S.C. 154(b) by 43 days.

(21) Appl. No.: 17/087,577

(22) Filed: Nov. 2, 2020

(65) Prior Publication Data

US 2021/0160995 A1 May 27, 2021

(30) Foreign Application Priority Data

Nov. 25, 2019 (TW) ..... 108142786

(51) Int. Cl.
*H05H 1/24* (2006.01)

(52) U.S. Cl.
CPC ..... *H05H 1/2406* (2013.01); *H05H 1/2425* (2021.05)

(58) Field of Classification Search
None
See application file for complete search history.

(56) References Cited

U.S. PATENT DOCUMENTS 4,340,786 A * 7/1982 Tester ..... H01L 41/193 428/209
4,389,445 A * 6/1983 Yoshida ..... G11B 9/08 428/209
4,392,178 A * 7/1983 Radice ..... B29C 59/10 29/25.35
4,427,609 A * 1/1984 Broussoux ..... H01L 41/45 264/108
4,459,634 A * 7/1984 Stefanou ..... H01L 41/257 29/25.35

(Continued)

FOREIGN PATENT DOCUMENTS

EP 1215737 A2 * 6/2002 ..... H01L 41/087
TW I239027 B 9/2005

(Continued)

*Primary Examiner* — Srinivas Sathiraju
(74) *Attorney, Agent, or Firm* — CKC & Partners Co., LLC

(57) ABSTRACT

A polarization apparatus includes a conductive carrier, a dielectric barrier discharge (DBD) plasma source, an electric net, a DBD power supply, and a DC power supply. The conductive carrier has a carrying surface which is configured to carry a work piece. The work piece includes a piezoelectric material film, and the conductive carrier is grounded. The DBD plasma source is disposed over the carrying surface and is configured to apply plasma toward the piezoelectric material film. The electric net is disposed between the carrying surface and the DBD plasma source. The DBD power supply includes a first electrode and a second electrode, in which the first electrode is electrically connected to the DBD plasma source, and the second electrode is grounded. The DC power supply includes a third electrode and a fourth electrode. The third electrode is electrically connected to the electric net, and the fourth electrode is grounded.

20 Claims, 11 Drawing Sheets

(56) References Cited

U.S. PATENT DOCUMENTS

| | | | | | |
|---|---|---|---|---|---|
| 4,508,668 | A * | 4/1985 | Broussoux | H01L 41/45 | 264/435 |
| 4,557,880 | A * | 12/1985 | Pantelis | H01L 41/45 | 427/100 |
| 4,670,074 | A * | 6/1987 | Broussoux | H01L 41/45 | 156/244.14 |
| 5,663,606 | A * | 9/1997 | Beurrier | H01L 41/257 | 310/357 |
| 6,593,681 | B2 * | 7/2003 | Ebisawa | H01L 41/45 | 264/436 |
| 7,134,197 | B2 * | 11/2006 | Shiffer | H01L 21/67005 | 428/209 |
| 10,002,114 | B2 * | 6/2018 | Knoulich | G06F 9/451 | |
| 2002/0140323 | A1 * | 10/2002 | Ebisawa | H01L 41/45 | 310/357 |
| 2009/0223030 | A1 * | 9/2009 | Tsukamoto | B41J 2/1628 | 29/25.35 |
| 2019/0342985 | A1 * | 11/2019 | Dadheech | B62D 35/00 | |
| 2021/0160995 | A1 * | 5/2021 | Lee | H05H 1/2406 | |
| 2021/0320242 | A1 * | 10/2021 | Lee | H01L 41/317 | |
| 2022/0003803 | A1 * | 1/2022 | Lee | G01R 29/12 | |

FOREIGN PATENT DOCUMENTS

| | | | | |
|---|---|---|---|---|
| TW | I355866 | B | 1/2012 | |
| TW | I623052 | B | 5/2018 | |
| WO | WO-9401265 | A1 * | 1/1994 | B29C 43/222 |

* cited by examiner

POLARIZATION APPARATUS

RELATED APPLICATIONS

This application claims priority to Taiwan Application Serial Number 108142786, filed Nov. 25, 2019, which is herein incorporated by reference.

BACKGROUND

Field of Invention

The present invention relates to a polarization technique of a piezoelectric material, and more particularly, to a polarization apparatus.

Description of Related Art

In recent years, piezoelectric materials have wide applications, and the applications include, for example, touch sensors of electronic products, military aircraft echolocation, ultrasonic buzzers and the likes. In order to meet requirements of specific applications, the piezoelectric materials sometimes need to be formed as films. Typically, it needs procedures of preparing a piezoelectric coating material, coating of the piezoelectric coating material, and performing a polarization treatment on the piezoelectric coating film to obtain the film having a piezoelectric property.

Molecular structures in the piezoelectric material have an asymmetric property, such that positively charged substances and negative charged substances are distributed nonuniformly, and local positive electrodes and local negative electrodes are formed in the molecular structures. Such a property is a cause for generating polarities of the piezoelectric material, in which a polarity direction is defined as a direction from the local negative electrode to the local positive electrode. An area where lattices have the same polarity direction is referred as an electrical domain.

The polarity directions of the electrical domains in the piezoelectric material are often irregular and are counteracted with each other to easily make the entire piezoelectric material have no polarity, such that the piezoelectric property of the material cannot be presented. Thus, the piezoelectric material usually needs to have a polarization process to coincide the directions the electrical domains in the piezoelectric material to present the piezoelectric property of the piezoelectric material.

A non-contact polarization technique performs polarization by using a high electric field to regularly arrange the molecules in the piezoelectric film along the electric field, so as to make the piezoelectric film present the piezoelectric property. The corona discharge is easily generated, and can provide a high electric field environment required by a polarization process, such that a corona discharge technique is now used to provide electrons. In some polarization apparatuses using the corona discharge technique, the electrons firstly pass through a negative high voltage grid and then arrive at a surface to be polarized.

However, the corona discharge technique has many disadvantages. For example, electric arcs are easily generated while corona discharging to breakdown and damage a work piece to be polarized. In order to prevent the electric arcs from being generated, the electric field cannot be too large, such that a polarization effect or a polarization rate of the piezoelectric material is limited. In addition, the corona discharging is locally discharging, such as single-point discharging or multi-point discharging, and is nonuniform, such that problems including treatment blind areas or nonuniform polarization are occurred. In order to enhance uniformity of the polarization process of the piezoelectric film, a transmission mechanism is typically used to move and/or rotate the electrode and/or the work piece to be polarized, so as to fully expose the entire surface of the piezoelectric film on the work piece to be polarized under the discharging region. However, such method prolongs time for the polarization process, and a larger space is required for the moving or rotating mechanism to complete the polarization process as the piezoelectric film is large.

SUMMARY

Therefore, one object of the present invention is to provide a polarization apparatus, which uses a dielectric barrier discharge (DBD) plasma source to replace a conventional corona discharge source, such that two-dimensional uniform plasma is generated, and thus problems including polarization blind zones and nonuniform discharge are prevented, thereby enhancing polarization uniformity.

Another objective of the present invention is to provide a polarization apparatus, which can generate uniform plasma, such that a moving mechanism and/or a rotatory mechanism are unnecessary, and time for a polarization treatment needs not to be prolonged, thereby increasing a polarization rate and decreasing apparatus cost and space required by the apparatus. In addition, the polarization apparatus can be applied in a batch polarization process, an in-line polarization process, a continuous roll-to-roll polarization process, such that applicability of the polarization apparatus is wide.

According to the aforementioned objectives, the present invention provides a polarization apparatus. The polarization apparatus includes a conductive carrier, a dielectric barrier discharge (DBD) plasma source, an electric net, a DBD power supply or a pulsed DC power supply (generally called as "DBD power supply"), and a DC power supply. The conductive carrier has a carrying surface which is configured to carry a work piece, in which the work piece includes a piezoelectric material film, and the conductive carrier is grounded. The DBD plasma source is disposed over the carrying surface and is configured to apply plasma toward the piezoelectric material film. The electric net is disposed between the carrying surface and the DBD plasma source. The DBD power supply includes a first electrode and a second electrode, in which the first electrode is electrically connected to the DBD plasma source, and the second electrode is grounded. The DC power supply includes a third electrode and a fourth electrode, in which the third electrode is electrically connected to the electric net, and the fourth electrode is grounded.

According to one embodiment of the present invention, the DBD plasma source includes an electrode and a dielectric layer. The electrode is electrically connected to the first electrode. The dielectric layer is connected to a bottom surface of the electrode.

According to one embodiment of the present invention, the electric net includes a grid structure or various lines, and the lines are arranged at a predetermined pitch.

According to the aforementioned objectives, the present invention further provides a polarization apparatus. The polarization apparatus includes a conductive carrier, a dielectric barrier discharge (DBD) plasma source, a DBD power supply, and a DC bias power supply. The conductive carrier has a carrying surface which is configured to carry a work piece, in which the work piece includes a piezoelectric material film. The DBD plasma source is disposed over the carrying surface and is configured to apply plasma toward the piezoelectric material film. The DBD power supply includes a first electrode and a second electrode, in which the first electrode is electrically connected to the DBD plasma source, and the second electrode is grounded. The DC bias power supply includes a fifth electrode and a sixth electrode, in which the fifth electrode is electrically connected to the conductive carrier, and the sixth electrode is grounded to provide the conductive carrier with a bias.

According to one embodiment of the present invention, the polarization apparatus includes an electric net and a DC power supply. The electric net is disposed between the carrying surface and the DBD plasma source. The DC power supply includes a third electrode and a fourth electrode, in which the third electrode is electrically connected to the electric net, and the fourth electrode is grounded.

According to one embodiment of the present invention, the electric net includes a grid structure or various lines, and the lines are arranged at a predetermined pitch.

According to the aforementioned objectives, the present invention further provides a polarization apparatus. The polarization apparatus includes a chamber, various conductive carriers, various dielectric barrier discharge (DBD) plasma sources, various electric nets, at least one DBD power supply, and at least one DC power supply. The chamber has a room. The conductive carriers are disposed within the room, in which each of the conductive carriers has a carrying surface configured to carry a work piece, each of the work pieces includes a piezoelectric material film, and the conductive carriers are grounded. The DBD plasma sources are disposed within the room and are respectively corresponding to and disposed over the carrying surfaces, in which the DBD plasma sources are configured to apply plasma toward the piezoelectric material films on the corresponding carrying surfaces. The electric nets are respectively disposed between the carrying surfaces and the corresponding DBD plasma sources. Each of the at least one DBD power supply includes a first electrode and a second electrode, the first electrode is electrically connected to the DBD plasma sources, and the second electrode is grounded. Each of the at least one DC power supply includes a third electrode and a fourth electrode, the third electrode is electrically connected to the electric nets, and the fourth electrode is grounded.

According to one embodiment of the present invention, each of the electric nets includes a grid structure or various lines, and the lines are arranged at a predetermined pitch.

According to the aforementioned objectives, the present invention further provides a polarization apparatus. The polarization apparatus includes a chamber, various conductive carriers, various dielectric barrier discharge (DBD) plasma sources, at least one DBD power supply, and at least one DC bias power supply. The chamber has a room. The conductive carriers are disposed within the room, in which each of the conductive carriers has a carrying surface configured to carry a work piece, and each of the work pieces includes a piezoelectric material film. The DBD plasma sources are disposed within the room and are respectively corresponding to and disposed over the carrying surfaces, in which the DBD plasma sources are configured to apply plasma toward the piezoelectric material films on the corresponding carrying surfaces. Each DBD power supply includes a first electrode and a second electrode, the first electrode is electrically connected to the DBD plasma sources, and the second electrode is grounded. Each DC bias power supply includes a fifth electrode and a sixth electrode, the fifth electrode is electrically connected to the conductive carriers, and the sixth electrode is grounded to provide each of the conductive carriers with a bias.

According to one embodiment of the present invention, the polarization apparatus further includes various electric nets and at least one DC power supply. The electric nets are respectively disposed between the carrying surfaces and the DBD plasma sources. Each DC power supply includes a third electrode and a fourth electrode, in which the third electrode is electrically connected to the electric nets, and the fourth electrode is grounded.

According to one embodiment of the present invention, each of the electric nets includes a grid structure or various lines, and the lines are arranged at a predetermined pitch.

According to the aforementioned objectives, the present invention further provides a polarization apparatus. The polarization apparatus includes at least one conductive conveying mechanism, at least one dielectric barrier discharge (DBD) plasma source, at least one electric net, at least one DBD power supply, and at least one DC power supply. The conductive conveying mechanism is configured to convey a continuous work piece toward a direction, in which the continuous work piece includes a piezoelectric material film, and the conductive conveying mechanism is grounded. The DBD plasma source is disposed over a predetermined region of the conductive conveying mechanism and is configured to apply plasma toward the piezoelectric material film passing through the predetermined region. The electric net is disposed between the predetermined region of the conductive conveying mechanism and the DBD plasma source. Each DBD power supply includes a first electrode and a second electrode, in which the first electrode is electrically connected to the DBD plasma source, and the second electrode is grounded. Each DC power supply includes a third electrode and a fourth electrode, in which the third electrode is electrically connected to the electric net, and the fourth electrode is grounded.

According to one embodiment of the present invention, the conductive conveying mechanism includes various rollers, a conveyor belt, or various rollers and a conveyor belt disposed on the rollers. Each electric net includes a grid structure or various lines, and the lines are arranged at a predetermined pitch.

According to the aforementioned objectives, the present invention further provides a polarization apparatus. The polarization apparatus includes at least one conductive conveying mechanism, at least one dielectric barrier discharge (DBD) plasma source, at least one DBD power supply, and at least one DC bias power supply. The conductive conveying mechanism is configured to convey a continuous work piece toward a direction, in which the continuous work piece includes a piezoelectric material film. The DBD plasma source is disposed over a predetermined region of the conductive conveying mechanism and is configured to apply plasma toward the piezoelectric material film passing through the predetermined region. Each DBD power supply includes a first electrode and a second electrode, in which the first electrode is electrically connected to the at least one DBD plasma source, and the second electrode is grounded. Each DC bias power supply includes a fifth electrode and a sixth electrode, the fifth electrode is electrically connected to the conductive conveying mechanism, and the sixth electrode is grounded to provide the conductive conveying mechanism with a bias.

According to one embodiment of the present invention, the conductive conveying mechanism includes various rollers, a conveyor belt, or various rollers and a conveyor belt disposed on the rollers.

According to one embodiment of the present invention, the polarization apparatus further includes at least one electric net and at least one DC power supply. The electric net is disposed between the predetermined region of the conductive conveying mechanism and the DBD plasma source. Each DC power supply includes a third electrode and a fourth electrode, in which the third electrode is electrically connected to the electric net, and the fourth electrode is grounded.

According to the aforementioned objectives, the present invention further provides a polarization apparatus. The polarization apparatus includes a first roller, at least one dielectric barrier discharge (DBD) plasma source, an electric net, a second roller, a DBD power supply, and a DC power supply. The first roller is configured to roll and carry a continuous work piece, in which the continuous work piece includes a piezoelectric material film, and the first roller is grounded. The DBD plasma source is disposed over the first roller and is configured to apply plasma toward the piezoelectric material film. The electric net is disposed between the first roller and the DBD plasma source. The second roller is configured to receive and roll the continuous work piece which is from the first roller and passes through the plasma. The DBD power supply includes a first electrode and a second electrode, in which the first electrode is electrically connected to the DBD plasma source, and the second electrode is grounded. The DC power supply includes a third electrode and a fourth electrode, in which the third electrode is electrically connected to the electric net, and the fourth electrode is grounded.

According to one embodiment of the present invention, the continuous work piece includes a conductive substrate and the piezoelectric material film covering a surface of the conductive substrate.

According to one embodiment of the present invention, the continuous work piece is consisting of the piezoelectric material film.

According to the aforementioned objectives, the present invention further provides a polarization apparatus. The polarization apparatus includes a first roller, at least one dielectric barrier discharge (DBD) plasma source, a second roller, a DBD power supply, and a DC bias power supply. The first roller is configured to roll and carry a continuous work piece, in which the continuous work piece comprises a piezoelectric material film. The DBD plasma source is disposed over the first roller and is configured to apply plasma toward the piezoelectric material film. The second roller is configured to receive and roll the continuous work piece which is from the first roller and passes through the plasma. The DBD power supply includes a first electrode and a second electrode, in which the first electrode is electrically connected to the DBD plasma source, and the second electrode is grounded. The DC bias power supply includes a fifth electrode and a sixth electrode, in which the fifth electrode is electrically connected to the first roller, and the sixth electrode is grounded to provide the first roller with a bias.

According to one embodiment of the present invention, the polarization apparatus further includes an electric net and a DC power supply. The electric net is disposed between the first roller and the DBD plasma source. The DC power supply includes a third electrode and a fourth electrode, in which the third electrode is electrically connected to the electric net, and the fourth electrode is grounded.

According to one embodiment of the present invention, the continuous work piece includes a conductive substrate and the piezoelectric material film covering a surface of the conductive substrate.

According to one embodiment of the present invention, the continuous work piece is consisting of the piezoelectric material film.

BRIEF DESCRIPTION OF THE DRAWINGS

The invention can be more fully understood by reading the following detailed description of the embodiment, with reference made to the accompanying drawings as follows.

DETAILED DESCRIPTION

The following disclosure provides many different embodiments, or examples, for implementing different features of the disclosed subject matter. Specific examples of components and arrangements are described below to simplify embodiments of the present invention. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus/device may be otherwise oriented (rotated 90 degrees or at other orientations) and the spatially relative descriptors used herein may likewise be interpreted accordingly.

In view of the conventional corona discharge polarization technique having disadvantages including that an electric arc is easily generated to damage a work piece to be polarized, nonuniform discharge is generated to cause a nonuniform polarization of a piezoelectric material, and polarization of a piezoelectric film with a large area needs to be moved or rotated through a transmission mechanism or needs more time for a polarization process, the prevent invention provides polarization apparatuses. The polarization apparatuses of the embodiments of the present invention use a DBD plasma source to replace a conventional corona discharge source, such that two-dimensional uniform plasma is generated, and polarization uniformity is enhanced. The polarization uniformity is enhanced, such that a piezoelectric film with a large area can be effectively polarized without a transmission mechanism and prolonging time for a polarization treatment, thereby increasing a polarization rate and decreasing apparatus cost and space required by the apparatus. Thus, the polarization apparatuses have superior applicability.

Figure 1:
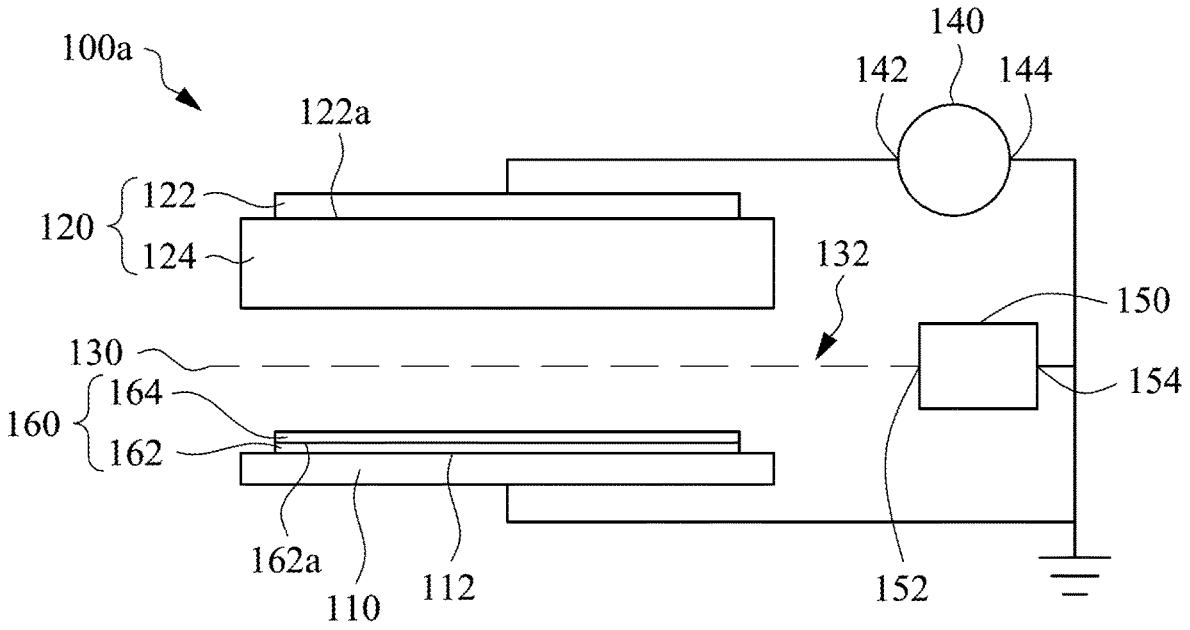
FIG. 1 is a schematic diagram of a polarization apparatus in accordance with a first embodiment of the present invention.

Referring to FIG. 1, FIG. 1 is a schematic diagram of a polarization apparatus in accordance with a first embodiment of the present invention. A polarization apparatus 100*a* may be used to perform a polarization treatment on a piezoelectric material film to regularly arrange molecules in the piezoelectric material film along an electric field, such that the piezoelectric material film has a piezoelectric property. In some embodiments, the polarization apparatus 100*a* mainly includes a conductive carrier 110, a DBD plasma source 120, an electric net 130, a DBD power supply 140, and a DC power supply 150.

The conductive carrier 110 may be made of metal, for example. In some examples, the conductive carrier 110 may be a flat structure. The conductive carrier 110 has a carrying surface 112. For example, as shown in FIG. 1, the carrying surface 112 of the conductive carrier 110 may be an upper surface of the conductive carrier 110. In the examples that the conductive carrier 110 is a flat structure, the carrying surface 112 is a flat surface. The carrying surface 112 of the conductive carrier 110 is configured to carry a work piece 160 to have a polarization treatment. In some examples, the conductive carrier 110 is grounded.

The work piece 160 includes a piezoelectric material film 164. For example, the piezoelectric material film 164 may include a polymer piezoelectric material, such as PVDF, or a piezoelectric ceramic material, such as PZT. In some examples, the work piece 160 further includes a substrate 162, and the piezoelectric material film 164 covers a surface 162*a* of the substrate 162. The substrate 162 may be made of a conductive material, for example.

The DBD plasma source 120 is disposed over the carrying surface 112 of the conductive carrier 110 and faces the carrying surface 112. The DBD plasma source 120 is configured to apply plasma toward the piezoelectric material film 164 of the work piece 160 carried by the carrying surface 112. In some examples, the DBD plasma source 120 may include an electrode 122 and a dielectric layer 124. The electrode 122 is made of a conductive material. The electrode 122 may be, for example, a flat structure. The electrode 122 has a bottom surface 122*a*. In the examples that the electrode 122 is a flat structure, the bottom surface 122*a* of the electrode 122 is a flat surface. The dielectric layer 124 covers and is connected to the bottom surface 122*a* of the electrode 122, and faces the carrying surface 112. Thus, the plasma generated by the dielectric layer 124 of the DBD plasma source 120 can be towards the carrying surface 112 of the conductive carrier 110.

Referring to FIG. 1 continuously, the electric net 130 is disposed between the carrying surface 112 of the conductive carrier 110 and the dielectric layer 124 of the DBD plasma source 120. In some exemplary examples, the electric net 130 is adjacent to the carrying surface 112 of the conductive carrier 110. In some examples, the electric net 130 is transversely over the carrying surface 112 of the conductive carrier 110. An extending direction of the electric net 130 may be, for example, substantially parallel to the carrying surface 112 of the conductive carrier 110. The electric net 130 has various opening holes 132, in which the opening holes 132 may uniformly pass through the electric net 130, for example. The electric net 130 may include a grid structure. In some examples, the electric net 130 may include various lines, in which the lines are arranged at a predetermined pitch. For example, the predetermined pitch between the lines is ranging from about 1 mm to about 10 mm.

The DBD power supply 140 is configured to apply electric power to the DBD plasma source 120. The DBD power supply 140 may apply alternating current or pulsed direct current to the DBD plasma source 120. The DBD power supply 140 may include a first electrode 142 and a second electrode 144, in which the first electrode 142 and the second electrode 144 have different electric potentials. The first electrode 142 of the DBD power supply 140 is electrically connected to the electrode 122 of the DBD plasma source 120, and the second electrode 144 may be grounded.

The DC power supply 150 is configured to apply electric power to the electric net 130. The DC power supply 150 may include a third electrode 152 and a fourth electrode 154, in which the third electrode 152 and the fourth electrode 154 have different electric potentials. The third electrode 152 of the DC power supply 150 is electrically connected to the electric net 130, and the fourth electrode 154 may be grounded.

When the DBD plasma source 120 jets plasma toward the carrying surface 112 of the conductive carrier 110, the electric net 130 can filter out chargers of one electrical property, and pass chargers of another different electrical property through the opening holes 132 of the electric net 130 to arrive the piezoelectric material film 164 of the work piece 160 on the carrying surface 112 of the conductive carrier 110 so as to perform a polarization process on the piezoelectric material film 164. For example, a portion of electrons in the plasma can pass through the opening holes 132 of the electric net 130 to polarize the piezoelectric material film 164.

The DBD plasma source 120 can generate two-dimensional uniform plasma, such that polarization uniformity of the piezoelectric material film 164 is enhanced, and a piezoelectric film having a larger area is effectively polarized without a transmission mechanism and prolonging time of a polarization treatment. Accordingly, the application of the polarization apparatus 100*a* can increase a polarization rate, reduce cost of the apparatus, and decrease a space required by the apparatus.

Figure 2:
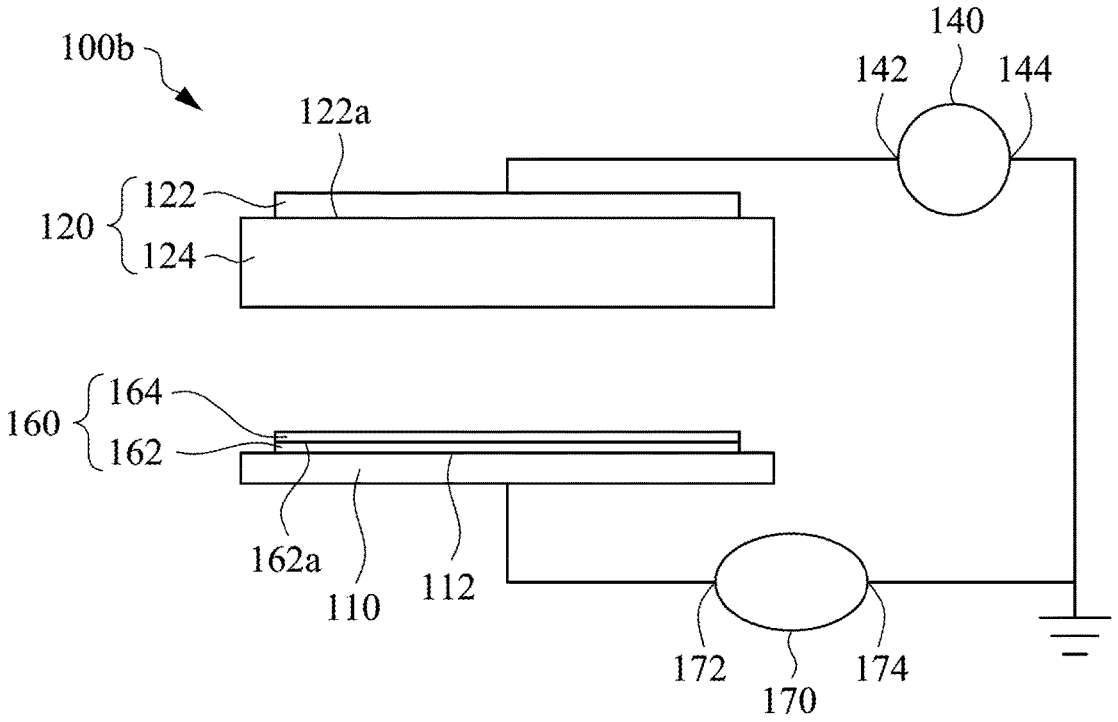
FIG. 2 is a schematic diagram of a polarization apparatus in accordance with a second embodiment of the present invention.

Referring to FIG. 2, FIG. 2 is a schematic diagram of a polarization apparatus in accordance with a second embodiment of the present invention. A structure of a polarization apparatus 100*b* of the present embodiment is similar to that of the polarization apparatus 100*a* of the aforementioned embodiment, differences therebetween are that no electric net is disposed between a DBD plasma source 120 and a conductive carrier 110 of the polarization apparatus 100*b*, and the polarization apparatus 100*b* further includes a DC bias power supply 170 to apply bias to the conductive carrier 110.

As shown in FIG. 2, the DC bias power supply 170 includes a fifth electrode 172 and a sixth electrode 174, in which the fifth electrode 172 and the sixth electrode 174 have different electric potentials. The fifth electrode 172 of the DC bias power supply 170 is electrically connected to the conductive carrier 110, and the sixth electrode 174 may be grounded to provide the conductive carrier 110 with a bias. Therefore, filter methods of the polarization apparatus 100*a* and 100*b* are different, in which the polarization apparatus 100*b* performs a polarization process on a piezoelectric material film 164 by applying the bias to the conductive carrier 110 to absorb chargers of an electrical property different from that of the conductive carrier 110. For example, the conductive carrier 110, which is positively charged by the electric power applied by the DC bias power supply 170, can absorb negatively-charged chargers in the plasma, such that the piezoelectric material film 164 carried on the conductive carrier 110 is polarized.

Figure 3:
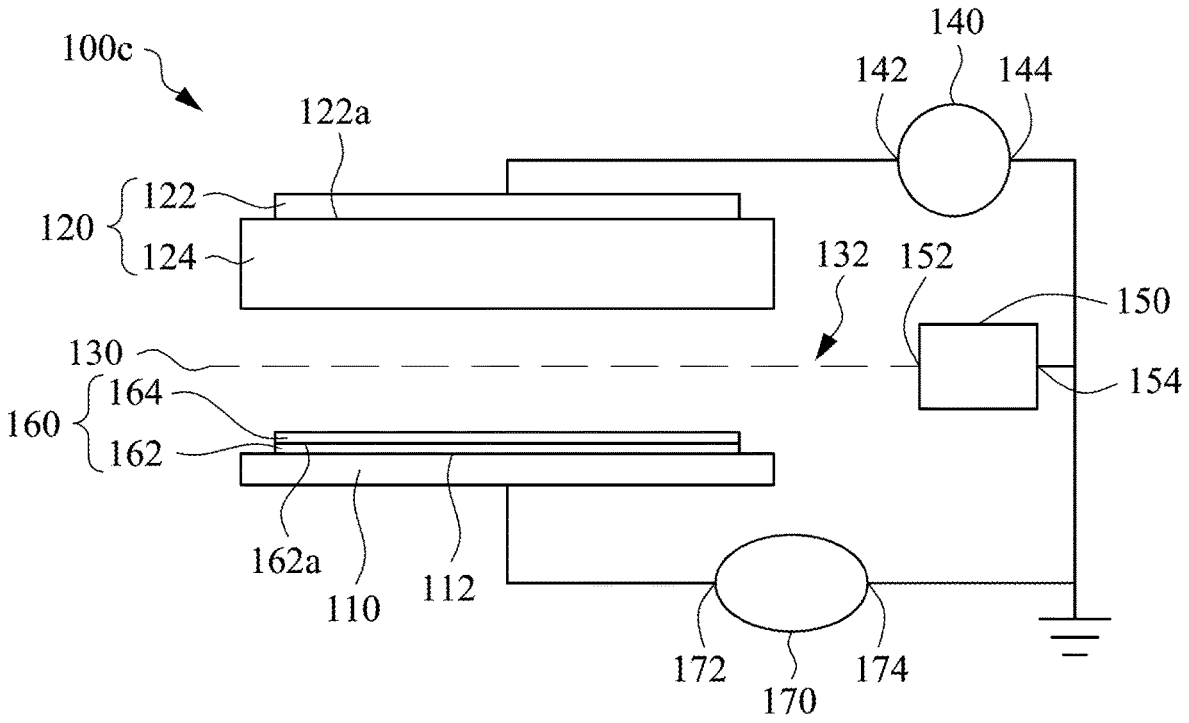
FIG. 3 is a schematic diagram of a polarization apparatus in accordance with a third embodiment of the present invention.

Referring to FIG. 3, FIG. 3 is a schematic diagram of a polarization apparatus in accordance with a third embodiment of the present invention. A structure of a polarization apparatus 100*c* is similar to that of the polarization apparatus 100*b* of the aforementioned embodiment, differences therebetween are that an electric net 130 is disposed between a DBD plasma source 120 and a conductive carrier 110 of the polarization apparatus 100*c*, and the polarization apparatus 100*c* further includes a DC power supply 150 which is used to apply an electric power to the electric net 130. Similar to the polarization apparatus 100*a* shown in FIG. 1, a third electrode 152 of the DC power supply 150 is electrically connected to the electric net 130, and a fourth electrode 154 is grounded.

The polarization apparatus 100*c* combines the charger-filtered method of the polarization apparatus 100*a* and the charger-absorbing method of the polarization apparatus 100*b*, such that chargers of a certain electrical property in plasma generated by the DBD plasma source 120, such as negatively-charged chargers, move to a piezoelectric material film 164 carried on the conductive carrier 110 more effectively to polarize the piezoelectric material film 164.

Figure 4:
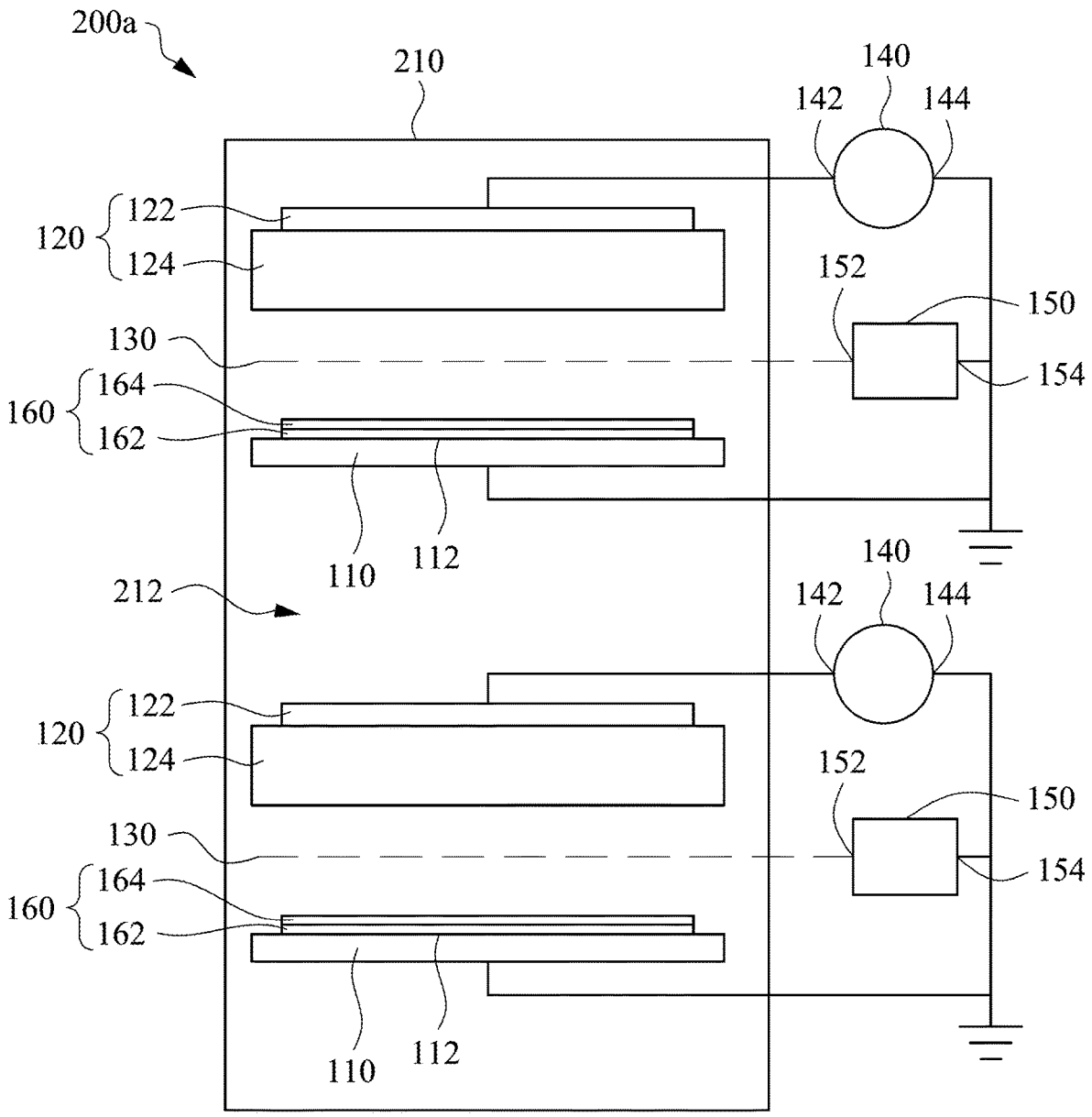
FIG. 4 is a schematic diagram of a polarization apparatus in accordance with a fourth embodiment of the present invention.

Polarization apparatuses of the present invention may be also used to perform a batch polarization process. Referring to FIG. 4, FIG. 4 is a schematic diagram of a polarization apparatus in accordance with a fourth embodiment of the present invention. A polarization apparatus 200*a* includes a chamber 210, various conductive carriers 110, various DBD plasma sources 120, various electric nets 130, at least one DBD power supply 140, and at least one DC power supply 150.

In the polarization apparatus 200*a*, the chamber 210 has a room 212. The room 212 may accommodate the conductive carriers 110, the DBD plasma sources 120, and the electric nets 130, and the DBD power supply 140 and the DC power supply 150 are disposed outside of the room 212 of the chamber 210. In some examples, the DBD power supply 140 and the DC power supply 150 may be also disposed within of the room 212 of the chamber 210. The chamber 210 may be a sealed chamber or an open chamber, such that the room 212 may be a sealed space or an open space.

The conductive carriers 110 are disposed within the room 212 of the chamber 210, and each conductive carrier 110 has a carrying surface 112 for carrying a work piece 160, such that a polarization process of piezoelectric material films 164 of the work pieces 160 can be performed within the room 212. Structures of the conductive carriers 110 and the work pieces 160 are described in the aforementioned embodiments, and are not repeated again. In this embodiment, these conductive carriers 110 may be grounded. These conductive carriers 110 may be connected to a ground wire set by parallel connection. In some other examples, these conductive carriers 110 may be respectively connected to various ground sire sets. These conductive carriers 110 may be in a static state, move back and forth, or rotate during the polarization process.

The DBD plasma sources 120 are similarly disposed within the room 212 of the chamber 210, respectively correspond to the conductive carriers 110, and are respectively located above the carrying surfaces 212 of the corresponding conductive carriers 110. With such, the DBD plasma sources 120 can apply plasma toward the piezoelectric material films 164 of the work pieces 160 carried on the carrying surfaces 112 of the corresponding conductive carriers 110.

The electric nets 130 are respectively disposed between the carrying surfaces 112 of the conductive carriers 110 and dielectric layers 124 of the corresponding DBD plasma sources 120. In some exemplary examples, qualities of the electric nets 130, the conductive carriers 110, and the DBD plasma sources 120 are the same. These electric nets 130 are transversely disposed over the carrying surfaces 112 of the conductive carriers 110, and may be respectively adjacent to the carrying surfaces 112 of the corresponding conductive carriers 110. The electric nets 130 have various opening holes 132 which are uniformly pass through the electric nets 130. Each electric net 130 may include a grid structure, or various lines arranged at a predetermined pitch, for example. Structures and arrangements of the electric nets 130, the conductive carriers 110, and the DBD plasma sources 120 are similar to those of the aforementioned embodiments, and are not repeated again herein.

The polarization apparatus 200*a* may include one or more DBD power supplies 140. For example, as shown in FIG. 4, the polarization apparatus 200*a* includes several DBD power supplies 140, and a quality of the DBD power supplies 140 is the same as that of the DBD plasma sources 120. In such examples, the DBD power supplies 140 are configured to respectively apply electric power to the corresponding DBD plasma sources 120. In the examples that the polarization apparatus 200*a* only has one DBD power supply 140, the DBD power supply 140 can apply electric power to all the DBD plasma sources 120, in which electrodes 122 of these DBD plasma sources 120 are connected to the DBD power supply 140 by parallel connection. Each DBD power supply 140 may include a first electrode 142 and a second electrode 144 which have different electric potentials, in which the first electrode 142 is electrically connected to the electrode 122 of the DBD plasma source 120, and the second electrode 144 may be grounded.

The polarization apparatus 200*a* may include one or more DC power supplies 150. For example, as shown in FIG. 4, the polarization apparatus 200*a* includes several DC power supplies 150, and a quality of the DC power supplies 150 is the same as that of the electric nets 130. In such examples, the DC power supplies 150 are configured to respectively apply electric power to the corresponding electric nets 130. In the examples that the polarization apparatus 200*a* only has one DC power supply 150, the DC power supply 150 can apply electric power to all the electric nets 130, in which the electric nets 130 are connected to the DC power supply 150 by parallel connection. Each DC power supply 150 may include a third electrode 152 and a fourth electrode 154 which have different electric potentials, in which the third electrode 152 is electrically connected to the electric net 130, and the fourth electrode 154 may be grounded.

With such design, a polarization process may be simultaneously performed on piezoelectric material films 164 of the work pieces 160 to obtain a batch polarization process effect, thereby greatly enhancing polarization efficiency.

Figure 5:
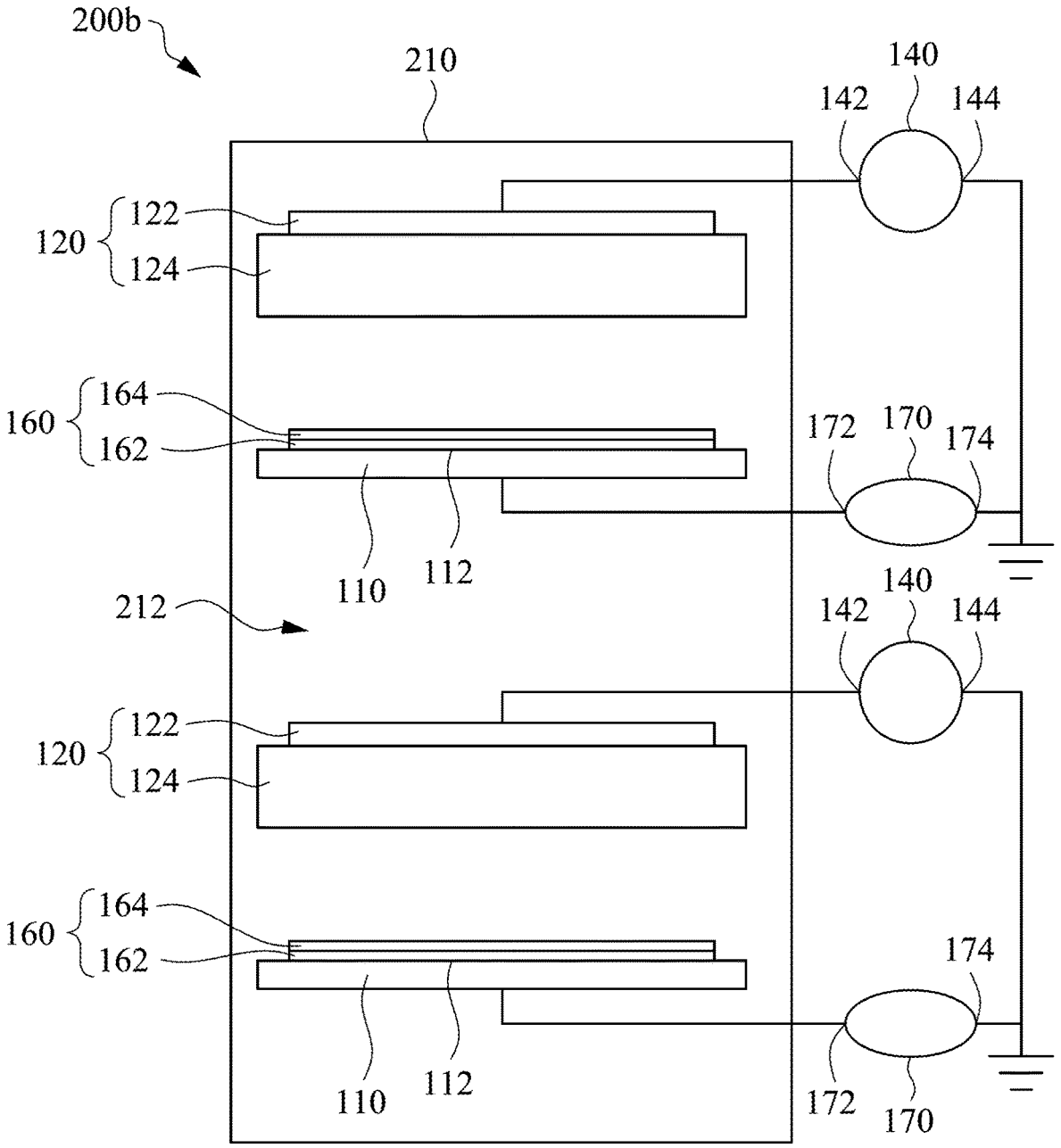
FIG. 5 is a schematic diagram of a polarization apparatus in accordance with a fifth embodiment of the present invention.

Referring to FIG. 5, FIG. 5 is a schematic diagram of a polarization apparatus in accordance with a fifth embodiment of the present invention. A structure of a polarization apparatus 200*b* of the present embodiment is similar to that of the polarization apparatus 200*a* of the aforementioned embodiment, differences therebetween are that no electric net is disposed between DBD plasma sources 120 and conductive carriers 110 of the polarization apparatus 200*b*, and the polarization apparatus 200*b* further includes at least one DC bias power supply 170 to apply bias to the conductive carriers 110.

The polarization apparatus 200*b* may include one or more DC bias power supplies 170. In some examples, as shown in FIG. 5, the polarization apparatus 200*b* includes several DC bias power supplies 170, and a quality of the DC bias power supplies 170 is the same as that of the conductive carriers 110. In such examples, the DC bias power supplies 170 are configured to respectively apply electric power to the corresponding conductive carriers 110. In the examples that the polarization apparatus 200*b* only has one DC bias power supply 170, the DC bias power supply 170 can apply electric power to all the conductive carriers 110, in which the conductive carriers 110 are connected to the DC bias power supply 170 by parallel connection. Each DC bias power supply 170 includes a fifth electrode 172 and a sixth electrode 174 which have different electric potentials, in which the fifth electrode 172 is electrically connected to the conductive carrier 110, and the sixth electrode 174 may be grounded to provide the conductive carriers 110 with a bias. The polarization apparatus 200*b* performs a polarization process on piezoelectric material films 164 by applying the bias to the conductive carriers 110 to absorb chargers of an electrical property different from that of the conductive carriers 110.

Figure 6:
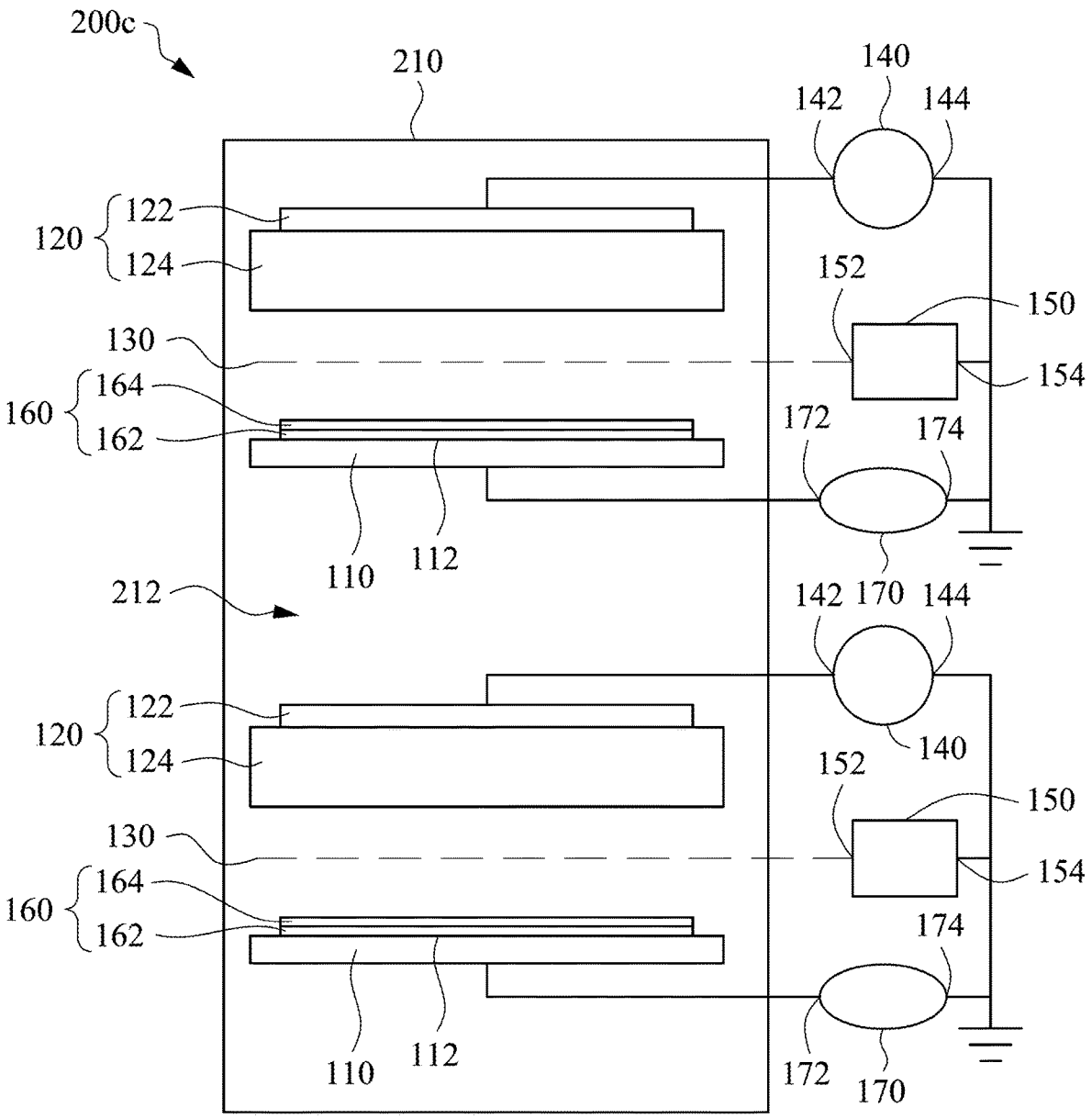
FIG. 6 is a schematic diagram of a polarization apparatus in accordance with a sixth embodiment of the present invention.

Referring to FIG. 6, FIG. 6 is a schematic diagram of a polarization apparatus in accordance with a sixth embodiment of the present invention. A structure of a polarization apparatus 200*c* is similar to that of the polarization apparatus 200*b* of the aforementioned embodiment, differences therebetween are that an electric net 130 is further disposed between each DBD plasma source 120 and a corresponding conductive carrier 110 of the polarization apparatus 200*c*, and the polarization apparatus 200*c* further includes at least one DC power supply 150 which is used to apply an electric power to the electric nets 130. Similar to the polarization apparatus 200*a* shown in FIG. 4, a third electrode 152 of the DC power supply 150 is electrically connected to the electric nets 130, and a fourth electrode 154 is grounded. A structure and a design of the DC power supply 150 of the polarization apparatus 200*c* are the same as those of the DC power supply 150 of the polarization apparatus 200*a*, and not repeated herein.

The polarization apparatus 200*c* combines the charger-filtered method of the polarization apparatus 200*a* and the charger-absorbing method of the polarization apparatus 200*b*, such that chargers of a certain electrical property in plasma generated by the DBD plasma sources 120 move to piezoelectric material films 164 carried on the corresponding conductive carriers 110 more effectively to polarize the piezoelectric material films 164 in a batch method.

Figure 7:
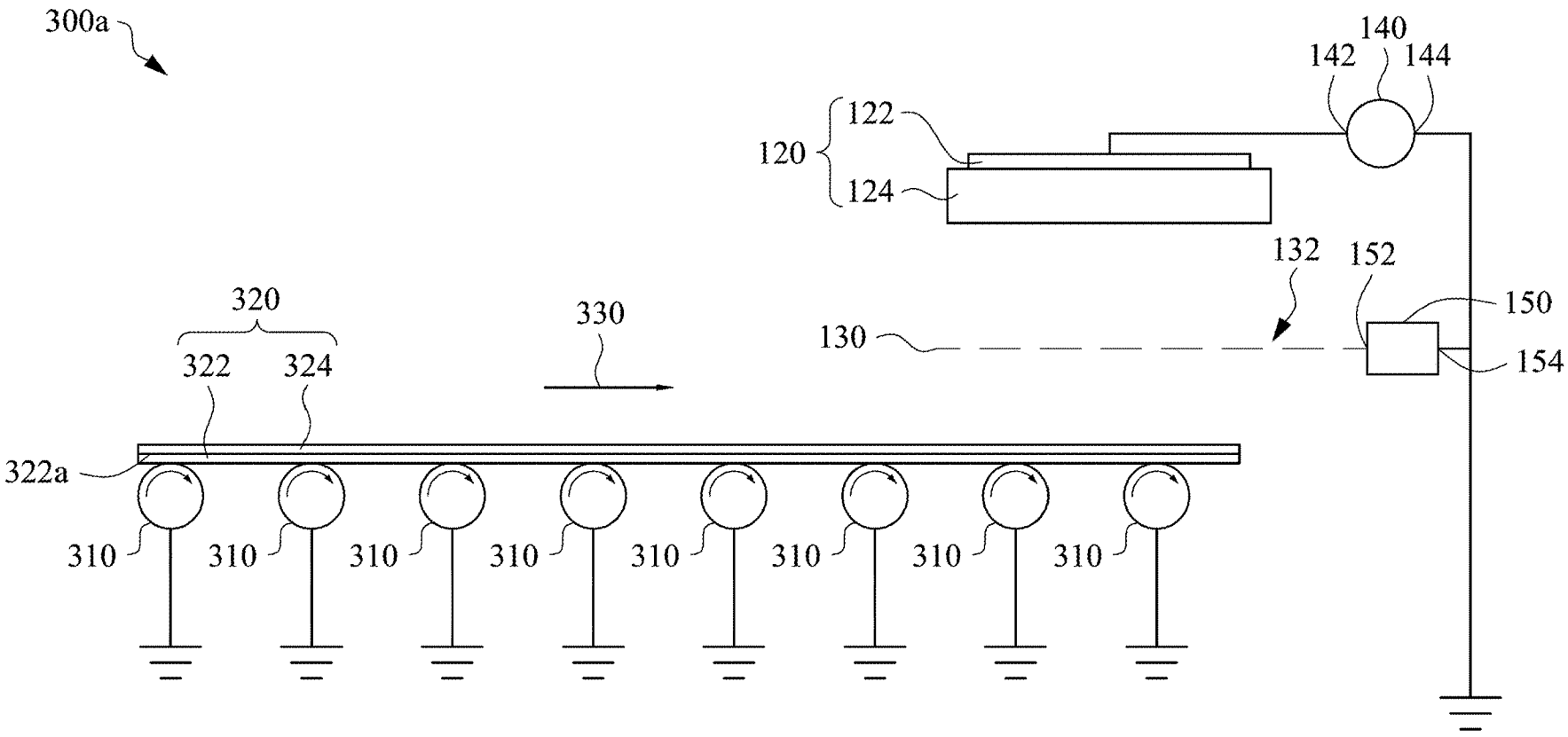
FIG. 7 is a schematic diagram of a polarization apparatus in accordance with a seventh embodiment of the present invention.

Polarization apparatuses of the present invention may be also used to perform a continuous polarization process. Referring to FIG. 7, FIG. 7 is a schematic diagram of a polarization apparatus in accordance with a seventh embodiment of the present invention. In some examples, a polarization apparatus 300*a* includes at least one conductive conveying mechanism 310, at least one DBD plasma source 120, at least one electric net 130, at least one DBD power supply 140, and at least one DC power supply 150. The polarization apparatus 300*a* may be used to perform a polarization process on a continuous work piece 320. The continuous work piece 320 includes a piezoelectric material film 324. The piezoelectric material film 324 may include, for example, a polymer piezoelectric material, such as PVDF, or a piezoelectric ceramic material, such as PZT. In some examples, the continuous work piece 320 further includes a substrate 322, in which the piezoelectric material film 324 covers a surface 322*a* of the substrate 322. The substrate 322 may be made of a conductive material, for example.

The polarization apparatus 300*a* includes one or more conductive conveying mechanism 310. For example, as shown in FIG. 7, the polarization apparatus 300*a* includes various conductive conveying mechanisms 310, and these conductive conveying mechanisms 310 are various rollers. In some other examples, the polarization apparatus 300*a* may include one single conveying mechanism, such as a conveyor belt, and the conveyor belt is conductive. In further other examples, the conductive conveying mechanism of the polarization apparatus 300*a* may include a combination of various rollers and a conveyor belt, in which the conveyor belt is disposed on the rollers. The conductive conveying mechanisms 310 are configured to convey the continuous work piece 320 toward a direction 330. In this embodiment, these conductive conveying mechanisms 310 may be grounded.

The polarization apparatus 300*a* may include one or more DBD plasma sources 120. The DBD plasma source 120 is disposed over a predetermined region 312 of the conductive conveying mechanism 310. For example, the predetermined region 312 of the conductive conveying mechanism 310 may be a downstream region. With such, the DBD plasma source 120 can apply plasma toward the piezoelectric material film 324 carried by the conductive conveying mechanism 310 and passing through the predetermined region 312 of the conductive conveying mechanism 310.

The polarization apparatus 300*a* may include one or more electric nets 130. The electric net 130 is disposed over the predetermined region 312 of the conductive conveying mechanism 310, and between the predetermined region 312 of the conductive conveying mechanism 310 and the DBD plasma source between the predetermined region 312 of the conductive conveying mechanism 310 and the DBD plasma source 120. In some exemplary examples, qualities of the electric nets 130 and the DBD plasma sources 120 are the same. The electric net 130 is transversely disposed over the predetermined region 312 of the conductive conveying mechanism 310 and is adjacent to the conductive conveying mechanism 310. The electric net 130 may include a grid structure, or various lines arranged at a predetermined pitch, for example. Structures and arrangements of the electric net 130 and the DBD plasma source 120 are similar to those of the aforementioned embodiments, and are not repeated again.

Referring to FIG. 7 continuously, the polarization apparatus 300*a* may include one or more DBD power supplies 140. A quality of the DBD power supplies 140 may be, for example, the same as that of the DBD plasma sources 120. The DBD power supply 140 is configured to apply electric power to the DBD plasma source 120. The DBD power supply 140 includes a first electrode 142 and a second electrode 144, in which the first electrode 142 is electrically connected to an electrode 122 of the DBD plasma source 120, and the second electrode 144 is grounded.

The polarization apparatus 300*a* may include one or more DC power supplies 150. A quality of the DC power supplies 150 is the same as that of the electric nets 130. The DC power supply 150 may include a third electrode 152 and a fourth electrode 154 which have different electric potentials, in which the third electrode 152 is electrically connected to the electric net 130, and the fourth electrode 154 may be grounded.

With such design, when the conductive conveying mechanism 310 conveys the continuous work piece 320 toward the direction 330, the DBD plasma source 120 can apply plasma to the piezoelectric material film 324 of the continuous work piece 320 passing through the predetermined region 312 via the electric net 130, so as to perform a polarization process on the piezoelectric material film 324 of the continuous work piece 320 passing through the predetermined region 312. Therefore, the piezoelectric material film 324 of the continuous work piece 320 can be polarized continuously.

Figure 8:
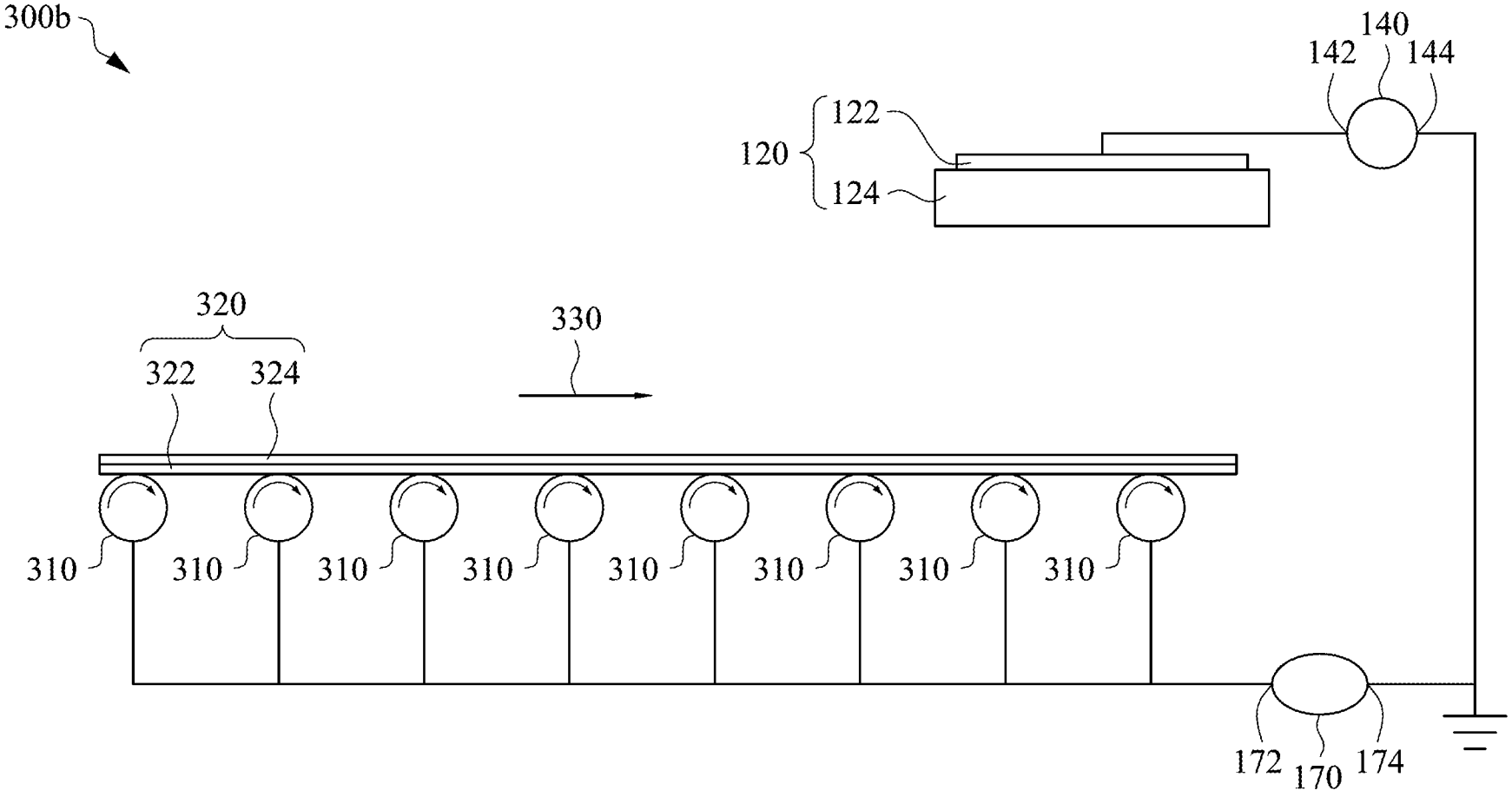
FIG. 8 is a schematic diagram of a polarization apparatus in accordance with an eighth embodiment of the present invention.

Referring to FIG. 8, FIG. 8 is a schematic diagram of a polarization apparatus in accordance with an eighth embodiment of the present invention. A structure of a polarization apparatus 300*b* of the present embodiment is similar to that of the polarization apparatus 300*a*, differences therebetween are that no electric net is disposed between a DBD plasma source 120 and a conductive conveying mechanism 310 of the polarization apparatus 300*b*, and the polarization apparatus 300*b* additionally includes at least one DC bias power supply 170 to apply bias to the conductive conveying mechanism 310.

As shown in FIG. 8, the DC bias power supply 170 includes a fifth electrode 172 and a sixth electrode 174, in which the fifth electrode 172 and the sixth electrode 174 have different electric potentials. The fifth electrode 172 of the DC bias power supply 170 is electrically connected to the conductive conveying mechanism 310, and the sixth electrode 174 may be grounded to provide the conductive conveying mechanism 310 with a bias. With such, the polarization apparatus 300*b* can continuously perform a polarization process on piezoelectric material films 324 by applying the bias to the conductive conveying mechanism 310 to absorb chargers of an electrical property different from that of the conductive conveying mechanism 310.

Figure 9:
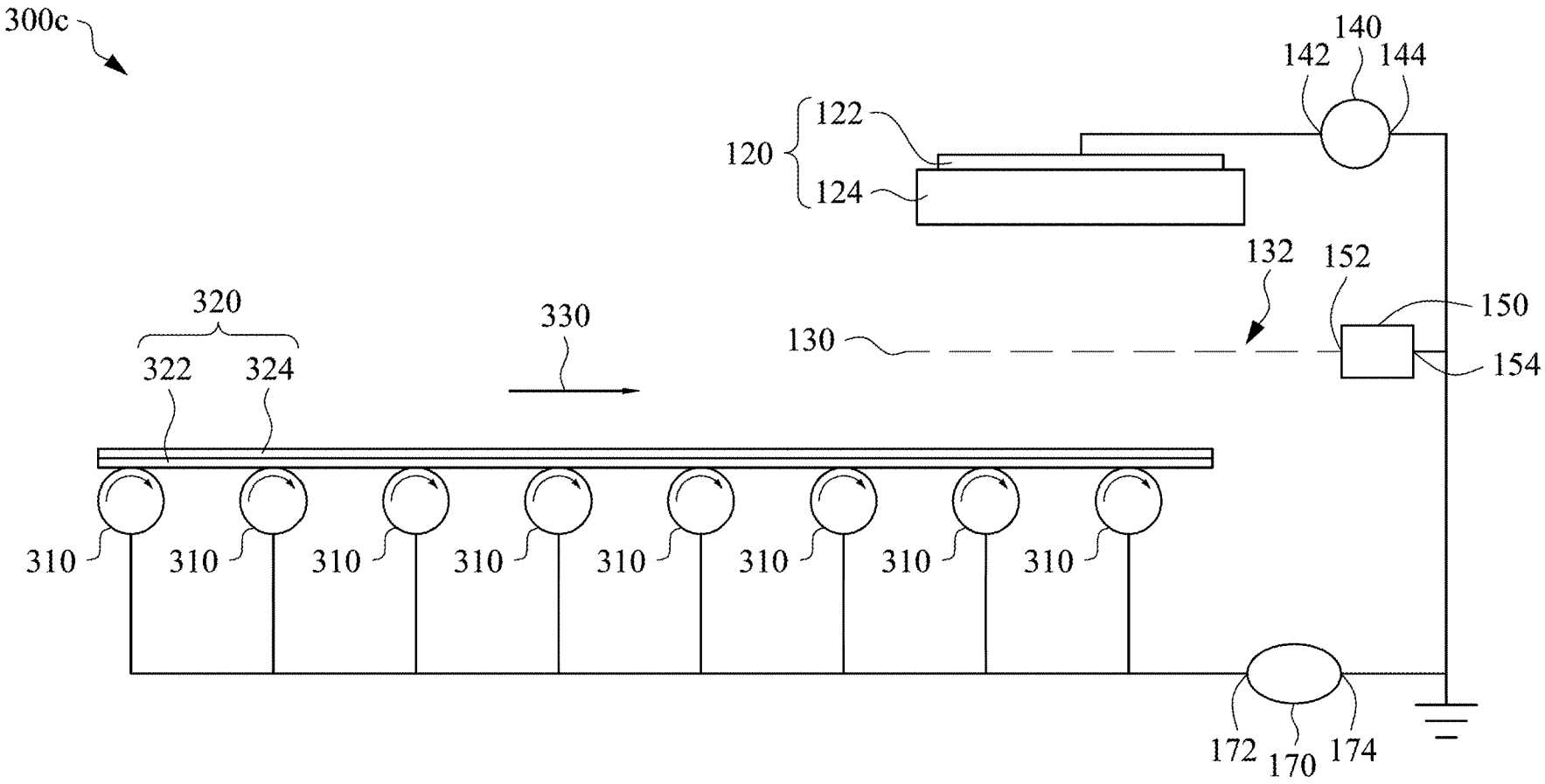
FIG. 9 is a schematic diagram of a polarization apparatus in accordance with a ninth embodiment of the present invention.

Referring to FIG. 9, FIG. 9 is a schematic diagram of a polarization apparatus in accordance with a ninth embodiment of the present invention. A structure of a polarization apparatus 300*c* is similar to that of the polarization apparatus 300*b* of the aforementioned embodiment, differences therebetween are that an electric net 130 is further disposed between a DBD plasma source 120 and a conductive conveying mechanism 310 of the polarization apparatus 300*c*, and the polarization apparatus 300*c* further includes at least one DC power supply 150 which is used to apply an electric power to the electric net 130. Similar to the polarization apparatus 300*a* shown in FIG. 7, a third electrode 152 of the DC power supply 150 is electrically connected to the electric net 130, and a fourth electrode 154 is grounded. A structure and a design of the DC power supply 150 of the polarization apparatus 300*c* are the same as those of the DC power supply 150 of the polarization apparatus 300*a*, and are not repeated herein.

The polarization apparatus 300*c* combines the charger-filtered method of the polarization apparatus 300*a* and the charger-absorbing method of the polarization apparatus 300*b*, such that chargers of a certain electrical property in plasma generated by the DBD plasma sources 120 move to a piezoelectric material film 324 of the continuous work piece 320 carried by the conductive conveying mechanism 310 more effectively to continuously polarize the piezoelectric material film 324.

Figure 10:
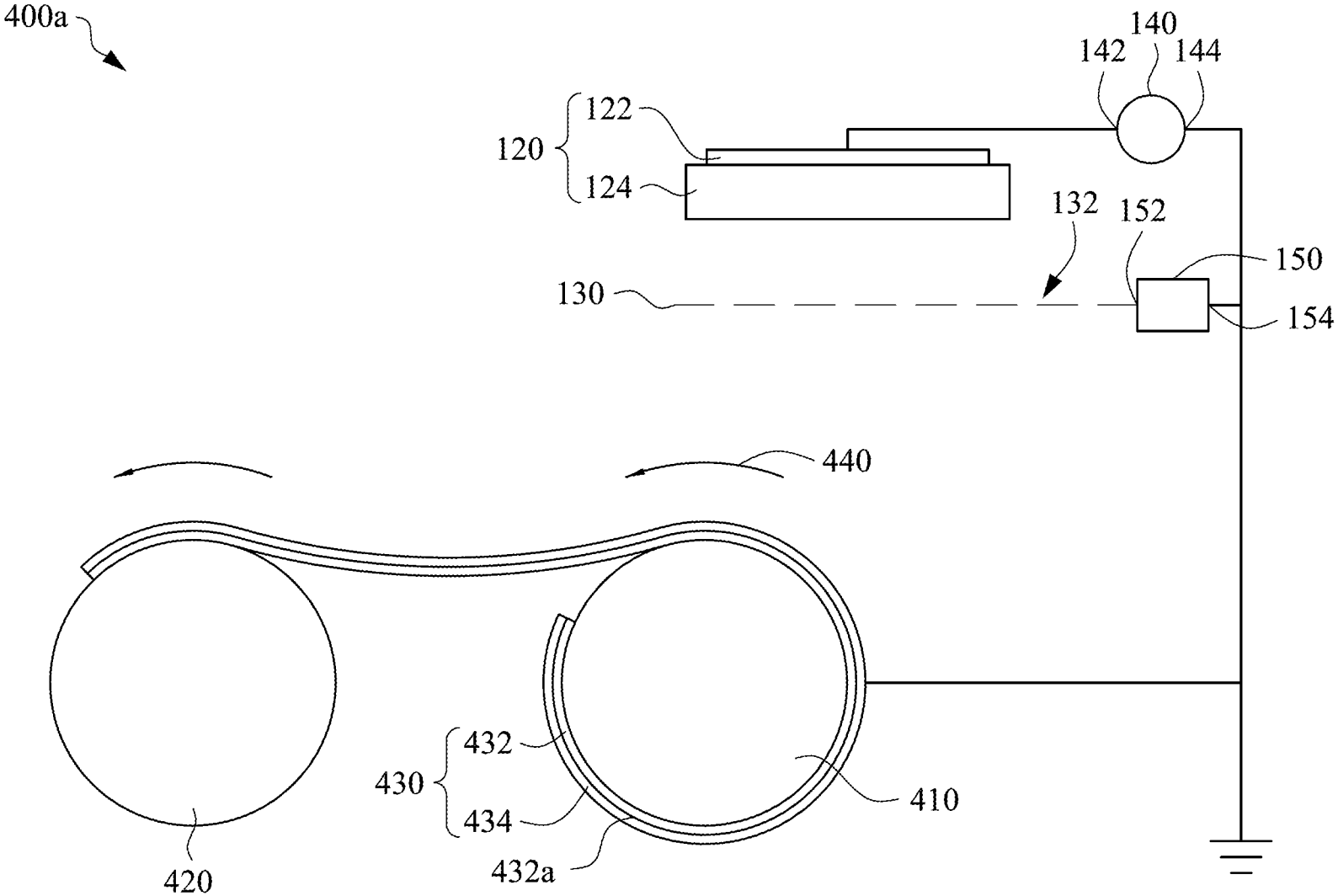
FIG. 10 is a schematic diagram of a polarization apparatus in accordance with a tenth embodiment of the present invention.

Polarization apparatuses of the present invention may be also used to perform a continuous roll-to-roll polarization process. Referring to FIG. 10, FIG. 10 is a schematic diagram of a polarization apparatus in accordance with a tenth embodiment of the present invention. The polarization apparatus 400*a* may mainly include a first roller 410, a DBD plasma source 120, an electric net 130, a second roller 420, a DBD power supply 140, and a DC power supply 150. The polarization apparatus 400*a* may be used to perform a polarization process on a continuous work piece 430. The continuous work piece 430 includes a piezoelectric material film 424. The piezoelectric material film 424 may include, for example, a polymer piezoelectric material, such as PVDF, or a piezoelectric ceramic material, such as PZT. In some examples, the continuous work piece 430 further includes a conductive substrate 432, in which the piezoelectric material film 434 covers a surface 432*a* of the conductive substrate 432. In the present embodiment, the continuous work piece 430 may be only consisting of the piezoelectric material film 434, or may include the conductive substrate 432 and the piezoelectric material film 434.

The first roller 410 is configured to roll and carry the continuous work piece 430, and the first roller 410 may rotate along a direction 440. In the example shown in FIG. 10, the direction 440 is counterclockwise. In the other examples, the first roller 410 may rotate along a clockwise direction. The rotation of the first roller 410 drives the continuous work piece 430 to rotate. In the embodiment, the first roller 410 is made of a conductive material, and the first roller 410 may be grounded.

The DBD plasma source 120 is disposed over the first roller 410. With such, the DBD plasma source 120 can apply plasma to the piezoelectric material film 434 which is carried by the roller 410 and passes through an underneath of the DBD plasma source 120.

The second roller 420 is configured to receive and roll the continuous work piece 430 which is from the first roller 410 and passes through the plasma applied by the DBD plasma source 120. The second roller 420 may rotate along the direction 440 similarly. When the second roller 420 rotates, the second roller 420 can receive and roll the continuous work piece 430 from the first roller 410 to achieve a continuous roll-to-roll polarization process.

The electric net 130 is disposed over the first roller 410, and is located between the first roller 410 and the DBD plasma source 120. The electric net 130 is transversely disposed over the first roller 410, extends along a length direction of the first roller 410, and is adjacent to the first roller 410. The electric net 130 may include a grid structure, or various lines arranged at a predetermined pitch, for example. Structures and arrangements of the electric net 130 and the DBD plasma source 120 are similar to those of the aforementioned embodiments, and are not repeated herein again.

The DBD power supply 140 is configured to apply electric power to the DBD plasma source 120. The DBD power supply 140 includes a first electrode 142 and a second electrode 144, in which the first electrode 142 is electrically connected to an electrode 122 of the DBD plasma source 120, and the second electrode 144 is grounded. The DC power supply 150 includes a third electrode 152 and a fourth electrode 154 which have different electric potentials, in which the third electrode 152 is electrically connected to the electric net 130, and the fourth electrode 154 may be grounded.

With such design, when the first roller 410 drives the continuous work piece 430 to rotate along the direction 440, the DBD plasma source 120 can apply plasma to the piezoelectric material film 434 of the continuous work piece 430, which passes through the underneath of the DBD plasma source 120, via the electric net 130, so as to perform a polarization process on the piezoelectric material film 434. Therefore, the piezoelectric material film 434 of the continuous work piece 430 can be polarized continuously by a roll-to-roll method.

Figure 11:
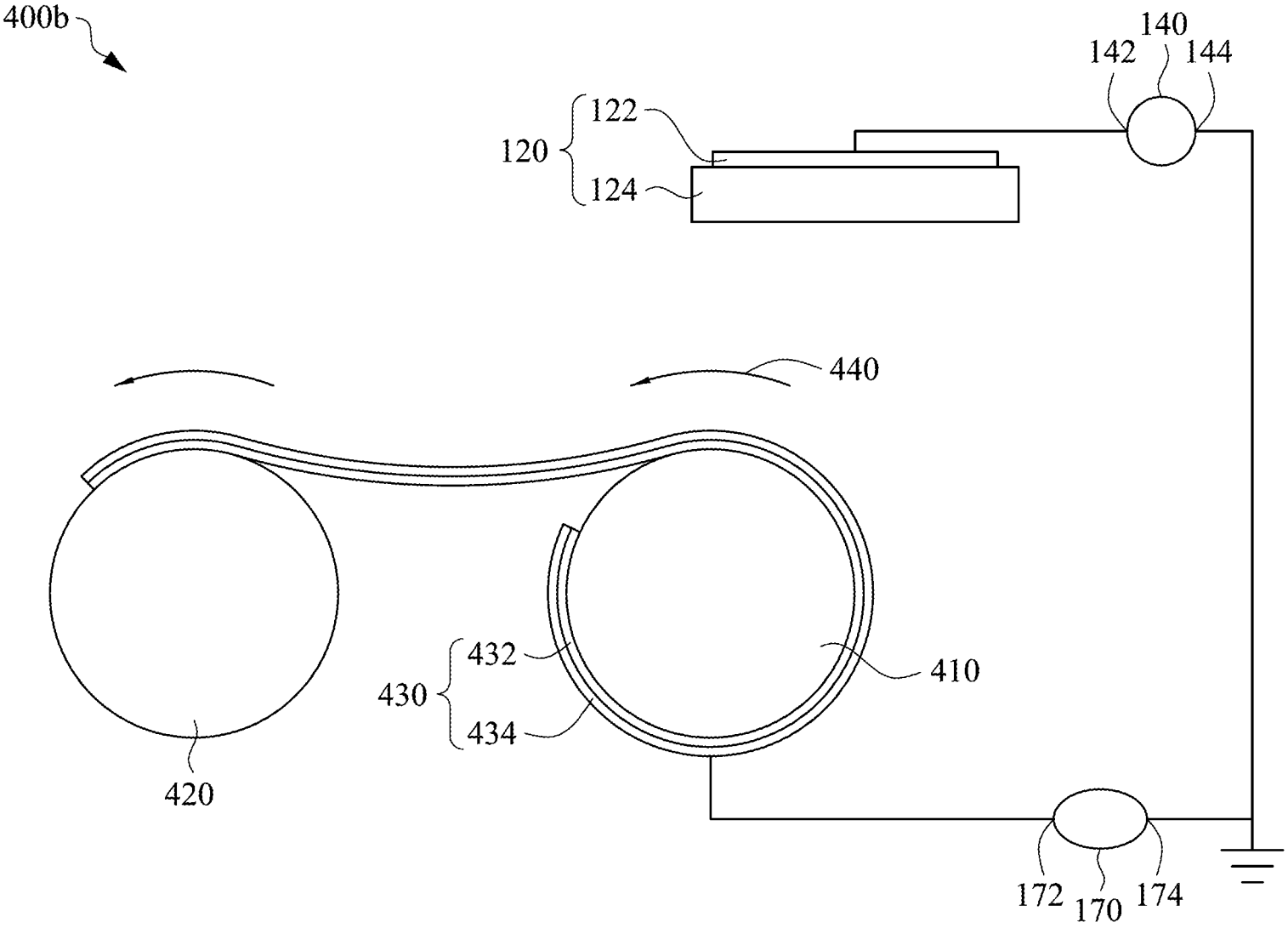
FIG. 11 is a schematic diagram of a polarization apparatus in accordance with an eleventh embodiment of the present invention.

Referring to FIG. 11, FIG. 11 is a schematic diagram of a polarization apparatus in accordance with an eleventh embodiment of the present invention. A structure of a polarization apparatus 400*b* of the present embodiment is similar to that of the polarization apparatus 400*a*, differences therebetween are that no electric net is disposed between a DBD plasma source 120 and a first roller 410 of the polarization apparatus 400*b*, and the polarization apparatus 400*b* additionally includes a DC bias power supply 170 to apply bias to the first roller 410.

The DC bias power supply 170 includes a fifth electrode 172 and a sixth electrode 174, in which the fifth electrode 172 and the sixth electrode 174 have different electric potentials. The fifth electrode 172 of the DC bias power supply 170 is electrically connected to the first roller 410, and the sixth electrode 174 may be grounded to provide the first roller 410 with a bias. With such, the polarization apparatus 400*b* can continuously perform a polarization process on piezoelectric material films 434 by roll-to-roll through applying the bias to the first roller 410 to absorb chargers of an electrical property different from that of the first roller 410.

Figure 12:
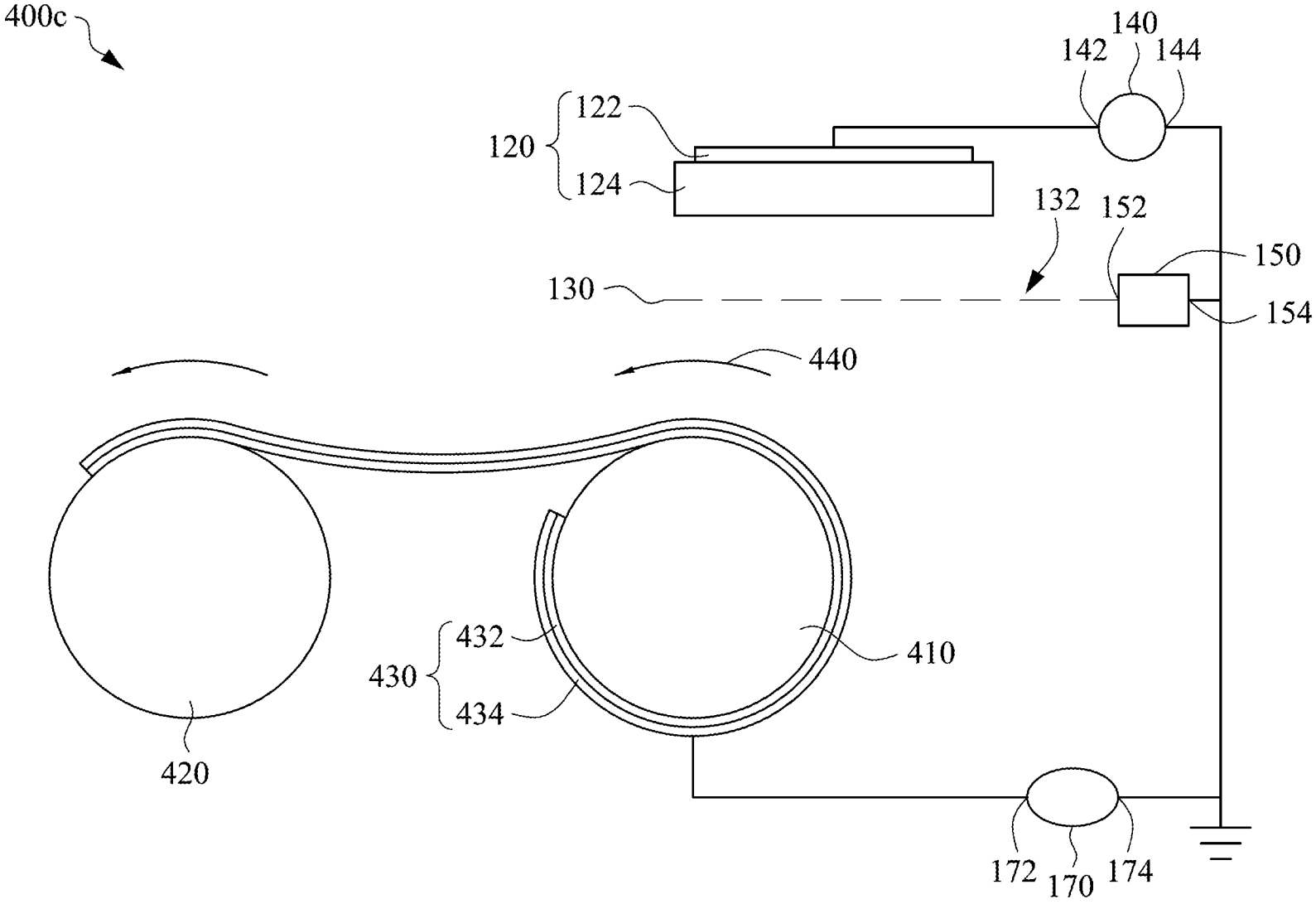
FIG. 12 is a schematic diagram of a polarization apparatus in accordance with a twelfth embodiment of the present invention.

Referring to FIG. 12, FIG. 12 is a schematic diagram of a polarization apparatus in accordance with a twelfth embodiment of the present invention. A structure of a polarization apparatus 400*c* is similar to that of the polarization apparatus 400*b* of the aforementioned embodiment, differences therebetween are that an electric net 130 is further disposed between a DBD plasma source 120 and a first roller 410 of the polarization apparatus 400*c*, and the polarization apparatus 400*c* further includes a DC power supply 150 which is used to apply an electric power to the electric net 130. Similar to the polarization apparatus 400*a* shown in FIG. 10, a third electrode 152 of the DC power supply 150 is electrically connected to the electric net 130, and a fourth electrode 154 is grounded. A structure and a design of the DC power supply 150 of the polarization apparatus 400*c* are the same as those of the DC power supply 150 of the polarization apparatus 400*a*, and are not repeated herein.

The polarization apparatus 400*c* combines the charger-filtered method of the polarization apparatus 400*a* and the charger-absorbing method of the polarization apparatus 400*b*, such that chargers of a certain electrical property in plasma generated by the DBD plasma sources 120 move to a piezoelectric material film 434 of the continuous work piece 430 carried and rolled by the first roller 410 more effectively to continuously polarize the piezoelectric material film 434 by a roll-to-roll method.

According to the aforementioned embodiments, one advantage of the present invention is that a polarization apparatus of the present invention uses a DBD plasma source to replace a conventional corona discharge source, such that two-dimensional uniform plasma is generated, and thus problems including polarization blind zones and non-uniform discharge are prevented, thereby enhancing polarization uniformity.

According to the aforementioned embodiments, another advantage of the present invention is that a polarization apparatus of the present invention can generate uniform plasma, such that a moving mechanism and/or a rotatory mechanism are unnecessary, and time for a polarization treatment needs not to be prolonged, thereby increasing a polarization rate and decreasing apparatus cost and space required by the apparatus. In addition, the polarization apparatus can be applied in a batch polarization process, an in-line polarization process, a continuous roll-to-roll polarization process, such that applicability of the polarization apparatus is wide.

Although the present invention has been described in considerable detail with reference to certain embodiments thereof, the foregoing embodiments of the present invention are illustrative of the present invention rather than limiting of the present invention. It will be apparent to those having ordinary skill in the art that various modifications and variations can be made to the present invention without departing from the scope or spirit of the invention. Therefore, the spirit and scope of the appended claims should not be limited to the description of the embodiments contained herein.

What is claimed is:

1. A polarization apparatus, comprising:

a conductive carrier having a carrying surface configured to carry a work piece, wherein the work piece comprises a piezoelectric material film, and the conductive carrier is grounded;

a dielectric barrier discharge (DBD) plasma source disposed over the carrying surface and configured to apply plasma toward the piezoelectric material film;

an electric net disposed between the carrying surface and the DBD plasma source;

a DBD power supply comprising a first electrode and a second electrode, wherein the first electrode is electrically connected to the DBD plasma source, and the second electrode is grounded; and a DC power supply comprising a third electrode and a fourth electrode, wherein the third electrode is electrically connected to the electric net, and the fourth electrode is grounded.

2. The polarization apparatus of claim 1, wherein the DBD plasma source comprises:

an electrode electrically connected to the first electrode; and a dielectric layer connected to a bottom surface of the electrode.

3. The polarization apparatus of claim 1, wherein the electric net comprises a grid structure consisting of a plurality of lines, and the lines are arranged at a predetermined pitch.

4. The polarization apparatus of claim 1, further comprising:

a DC bias power supply comprising a fifth electrode and a sixth electrode, wherein the fifth electrode is electrically connected to the conductive carrier, and the sixth electrode is grounded to provide the conductive carrier with a bias.

5. The polarization apparatus of claim 1, wherein an extending direction of the electric net is parallel to the carrying surface of the conductive carrier.

6. The polarization apparatus of claim 1, wherein the work piece further comprises a conductive substrate, and the piezoelectric material film covers a surface of the conductive substrate.

7. A polarization apparatus, comprising:

at least one conductive conveying mechanism configured to convey a continuous work piece toward a direction, wherein the continuous work piece comprises a piezoelectric material film, and the at least one conductive conveying mechanism is grounded;

at least one dielectric barrier discharge (DBD) plasma source disposed over a predetermined region of the at least one conductive conveying mechanism and configured to apply plasma toward the piezoelectric material film passing through the predetermined region;

at least one electric net disposed between the predetermined region of the at least one conductive conveying mechanism and the at least one DBD plasma source;

at least one DBD power supply, wherein each of the at least one DBD power supply comprises a first electrode and a second electrode, wherein the first electrode is electrically connected to the at least one DBD plasma source, and the second electrode is grounded; and at least one DC power supply, wherein each of the at least one DC power supply comprises a third electrode and a fourth electrode, wherein the third electrode is electrically connected to the at least one electric net, and the fourth electrode is grounded.

8. The polarization apparatus of claim 7, wherein the at least one conductive conveying mechanism comprises a plurality of rollers, a conveyor belt, or a plurality of rollers and a conveyor belt disposed on the rollers.

9. The polarization apparatus of claim 7, wherein each of the at least one electric net comprises a grid structure consisting of a plurality of lines, and the lines are arranged at a predetermined pitch.

10. The polarization apparatus of claim 7, wherein qualities of the at least one electric net and the at least one DBD plasma source are the same.

11. The polarization apparatus of claim 7, further comprising:

at least one DC bias power supply, wherein each of the at least one DC bias power supply comprises a fifth electrode and a sixth electrode, the fifth electrode is electrically connected to the at least one conductive conveying mechanism, and the sixth electrode is grounded to provide the at least one conductive conveying mechanism with a bias.

12. The polarization apparatus of claim 7, wherein each of the at least one DBD plasma source comprises:

an electrode electrically connected to the first electrode; and a dielectric layer connected to a bottom surface of the electrode.

13. The polarization apparatus of claim 7, wherein the continuous work piece further comprises a conductive substrate, and the piezoelectric material film covers a surface of the conductive substrate.

14. A polarization apparatus, comprising:

a first roller configured to roll and carry a continuous work piece, wherein the continuous work piece comprises a piezoelectric material film, and the first roller is grounded;

at least one dielectric barrier discharge (DBD) plasma source disposed over the first roller and configured to apply plasma toward the piezoelectric material film;

an electric net disposed between the first roller and the DBD plasma source;

a second roller configured to receive and roll the continuous work piece which is from the first roller and passes through the plasma;

a DBD power supply comprising a first electrode and a second electrode, wherein the first electrode is electrically connected to the DBD plasma source, and the second electrode is grounded; and a DC power supply comprising a third electrode and a fourth electrode, wherein the third electrode is electrically connected to the electric net, and the fourth electrode is grounded.

15. The polarization apparatus of claim 14, wherein the continuous work piece comprises:

a conductive substrate; and the piezoelectric material film covering a surface of the conductive substrate.

16. The polarization apparatus of claim 14, wherein the continuous work piece is consisting of the piezoelectric material film.

17. The polarization apparatus of claim 14, further comprising:

a DC bias power supply comprising a fifth electrode and a sixth electrode, wherein the fifth electrode is electrically connected to the first roller, and the sixth electrode is grounded to provide the first roller with a bias.

18. The polarization apparatus of claim 14, wherein the electric net comprises a grid structure consisting of a plurality of lines, and the lines are arranged at a predetermined pitch.

19. The polarization apparatus of claim 14, wherein the electric net extends along a length direction of the first roller.

20. The polarization apparatus of claim 14, wherein the DBD plasma source comprises:

an electrode electrically connected to the first electrode; and a dielectric layer connected to a bottom surface of the electrode.

* * * * *